US005226461A

United States Patent [19]

Macartney et al.

[11] Patent Number: 5,226,461

[45] Date of Patent: Jul. 13, 1993

[54] STRAP CRIMP AND CRIMPING TOOL

[75] Inventors: Robert M. Macartney, Lockport; Samuel Cicatello, East Amherst; Silas G. Goma, both of Amherst, all of N.Y.

[73] Assignee: General Motors Corporation, Detroit, Mich.

[21] Appl. No.: 794,083

[22] Filed: Nov. 18, 1991

[51] Int. Cl.[5] ..... B21F 9/02

[52] U.S. Cl. ..... 140/152; 140/93.2

[58] Field of Search ..... 140/93.2, 93.4, 152

[56] References Cited

U.S. PATENT DOCUMENTS

| | | | |
|---|---|---|---|
| 2,097,945 | 11/1937 | Childress | 140/93.2 |
| 3,034,384 | 5/1962 | Novak et al. | 150/152 |
| 4,298,061 | 1/1981 | Hoeffken | 165/170 |
| 4,306,511 | 12/1981 | Ashby et al. | 113/1 N |
| 4,334,703 | 6/1982 | Arthur et al. | 285/222 |
| 4,349,949 | 9/1982 | Kritzer | 29/157.3 A |
| 4,459,917 | 7/1984 | Michael et al. | 165/151 |

FOREIGN PATENT DOCUMENTS

| | | | |
|---|---|---|---|
| 443254 | 2/1936 | United Kingdom | 140/152 |

*Primary Examiner*—Lowell A. Larson

*Attorney, Agent, or Firm*—Ronald L. Phillips; Patrick M. Griffin

[57] ABSTRACT

A banding strap for holding together the parts of a heat exchanger core during a brazing operation is crimped at its overlapping ends by forming two longitudinally spaced pairs of tabs, each pair being on opposite side edges of the strap. The tabs are bent from the strap ends at an angle normal to the strap surface so that corresponding notches are formed in the strap. The crimping apparatus includes a clamp for holding one end of the strap, a knife for cutting off the strap from stock, a laminated anvil which descends onto one side the strap, and crimping blades which move around to the opposite side of the strap to push portions of the strap ends against the sharp edges of the anvil to form the tabs. A powered ram is coupled to each of the clamp, knife, anvil, and crimping elements to operate each element in proper sequence during ram motion.

6 Claims, 3 Drawing Sheets

STRAP CRIMP AND CRIMPING TOOL

FIELD OF THE INVENTION

This invention relates to an apparatus for crimping the ends of banding straps and to the resulting crimp.

BACKGROUND OF THE INVENTION

In the manufacture of heat exchangers such as automotive radiators and air conditioner evaporators many elements are assembled to form a core and are held together by steel bands for subsequent processing. The banded cores are subject to wash, flux, and brazing processes. It is critical that the band strap does not loosen from the core after it has been banded, especially in the brazing process, where the core is subjected to temperatures in excess of 1000° F. Failure in any of these stages would result in damage to the core and could also cause damage to the processing equipment. It is also essential that the strap itself or the application of the strap does not damage the core.

Apparatus for applying straps to such cores, known as band heads, typically employ a four step process for banding: feed, tension, crimp, and cut. In the feed cycle, strap is fed from stock material through a track which encloses the core. When the feeding is complete, the end of the strap is clamped and the tensioning step begins. The tensioning comprises pulling the strap from the opposite direction from which it was fed, thereby pulling the strap out of the track and around the core such that the strap overlaps its end. When the desired tension is reached, the strap is fastened or crimped at the overlap region to create a seal around the core. Then the strap is cut to separate the sealed loop portion of the strap from the stock material.

A number of techniques are known for securing the ends of the straps together. One band head requires an external clip to hold the strap ends, thereby mandating that a supply of the clips be maintained. Another known band head uses a key-hole notching approach which produces a strong seal but has short tool life.

SUMMARY OF THE INVENTION

It is therefore an object of the invention to provide a crimp configuration which is reliable in hot environments and which requires no separate clip.

It is another object to provide crimping apparatus which has long tool life and yields a strong seal.

The invention is carried out by a strap crimp for securing the ends of a banding strap comprising: a pair of overlapping strap ends meeting at an interface plane; first and second pairs of tabs spaced along the overlapping strap ends, each pair comprising tabs on opposite side edges of the overlapping strap ends; each tab comprising juxtaposed narrow tab portions of both of the strap ends bent in the same direction out of the plane of the strap to form a notch in each strap end such that the tab portion of one strap end extends through the notch of the other strap end to hold the strap ends against separating.

The invention is further carried out by a tool for crimping together the overlapping ends of a strap comprising: means for holding the strap in a crimping station; anvil means mounted for movement against a first side of the strap; blade means mounted for movement against a second side of the strap in cooperation with the anvil means for cutting crimp tabs from the overlapping strap ends and bending the tabs normal to the strap; the anvil means and the blade means having a rest position on the same side of the strap; and linear actuator means movable between a rest position and a work position and coupled directly to the anvil means for moving the anvil means from its rest position to its work position against the said first side of the strap; and a motion transfer mechanism coupling the linear actuator means to the blade means for moving the blade means from its rest position to its work position at the second side of the strap.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

Figure 1:
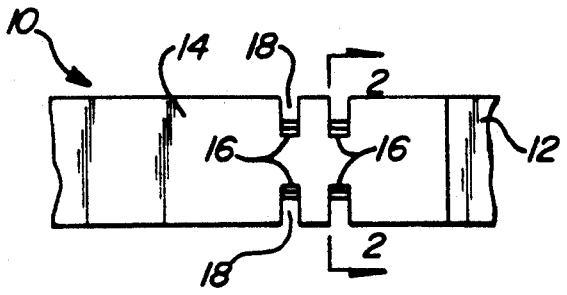
FIG. 1 is a top view of a strap crimp according to the invention.
Figure 2:
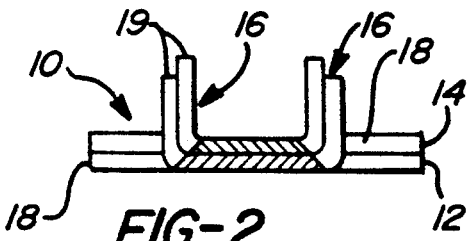
FIG. 2 is a sectional view along lines 2—2 of FIG. 1.
Figure 3:
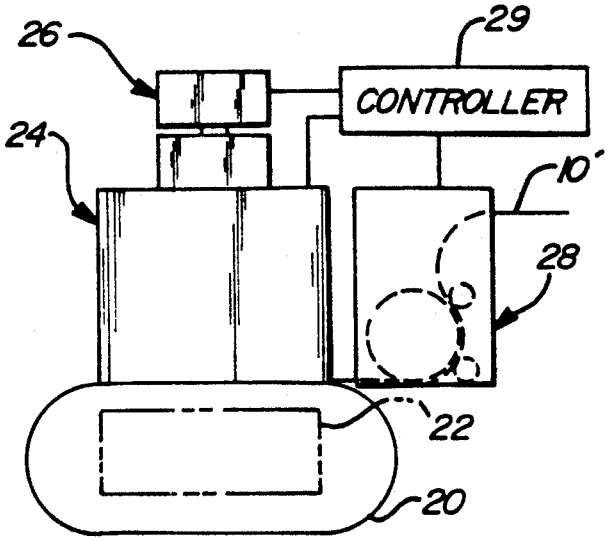
FIG. 3 is a schematic front view of strap crimping apparatus employing a band head according to the invention.

The crimp and the apparatus for making the crimp were specifically developed for a steel strap having a thickness of 0.015 inch and a width of ⅜ inch, but it should be evident that the invention is adaptable to other materials and dimensions. Referring to FIGS. 1 and 2, a banding strap is 10 is joined at a region of overlap of a lower end 12 and upper end 14. The ends are notched at two places along each side of the strap to produce two longitudinally spaced pairs of tabs 16, each tab being double layered. That is, a tab portion 19 of each strap end is bent upwardly to form a notch in the side edges of the strap ends so that the tab portion of the lower strap end extends through the notch in the upper strap end. Each notch 18 extends into the strap 10 about one third of the strap width, and the tabs extend at an angle of 90° to the surface of the strap with the tab portions 19 juxtaposed. The width of the tabs 16 and of the corresponding notches 18 is typically 0.094 inch and the longitudinal spacing of the tabs is 0.156 inch. This configuration gives good strength in tension and compression as well in torsion. During development smaller angles of tab bending as well as shorter tabs were tested and were deficient in torsional strength, the ends tending to break apart when twisted. Thus the preferred configuration as depicted in the drawings is the one with the greatest strength FIG. 3 is a front view of the banding apparatus. An oval track 20, surrounding or enclosing the core 22 or other object to be banded, is attached to the band head 24. The band head 24 contains the tooling for notching the strap ®nds and cutting off the strap from the supply. Tandem cylinders 26 on the band head 24 actuate the tooling. By using tandem cylinders, a first cylinder can be actuated to move the tooling partially through a prescribed path, and the second cylinder can be separately actuated to complete the tooling action. A feed device 28 meters strap stock 10' from a supply coil into the track 20 and retracts the stock during a tensioning step. The track is designed to release the strap when tension is applied. The oval track 20 and the feeding apparatus 28 are similar to those already known in the art and are not described herein in detail. An electrical controller 29 connected to the band head 24, the cylinders 26 and the feeding apparatus 28 initiates and coordinates the action of each one. Under the commands of the controller 29 the strap is fed by the device 28 into the oval track and when the end of the strap completes the path around the track and reaches the band head 24 so that the end overlaps the strap portion just newly fed in, the strap is gripped near the end by a clamp on the band head. Then the feed device pulls back on the strap until it is pulled from the track and the strap is tightened around the core 22. Then the band head is actuated to crimp the overlapping portions of the strap and cut off the crimped strap from the supply. Finally the crimped strap is released from the band head and the strap snaps against the core.

Figure 4:
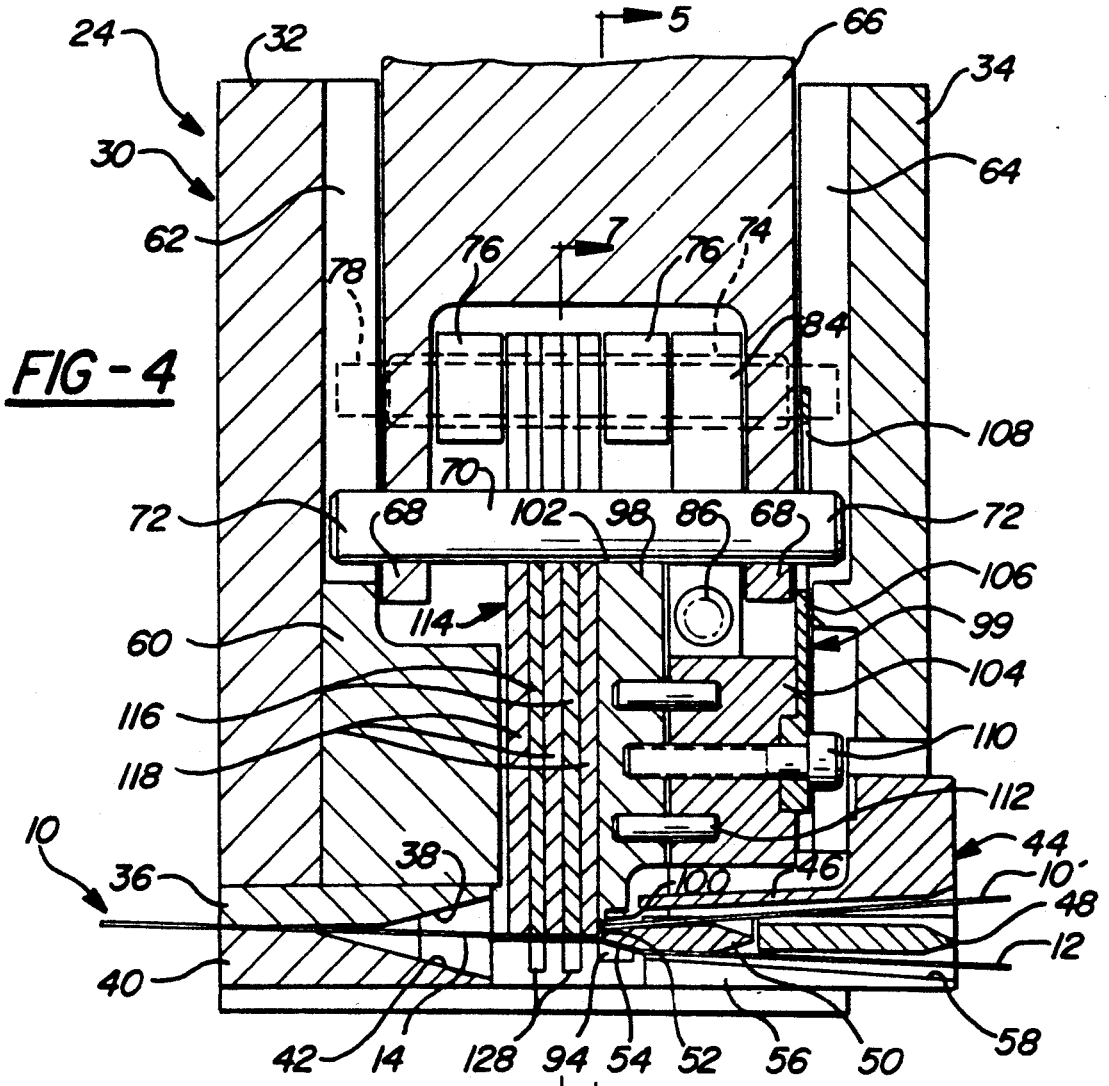
FIG. 4 is a cross-sectional view of a band head according to the invention.
Figure 5:
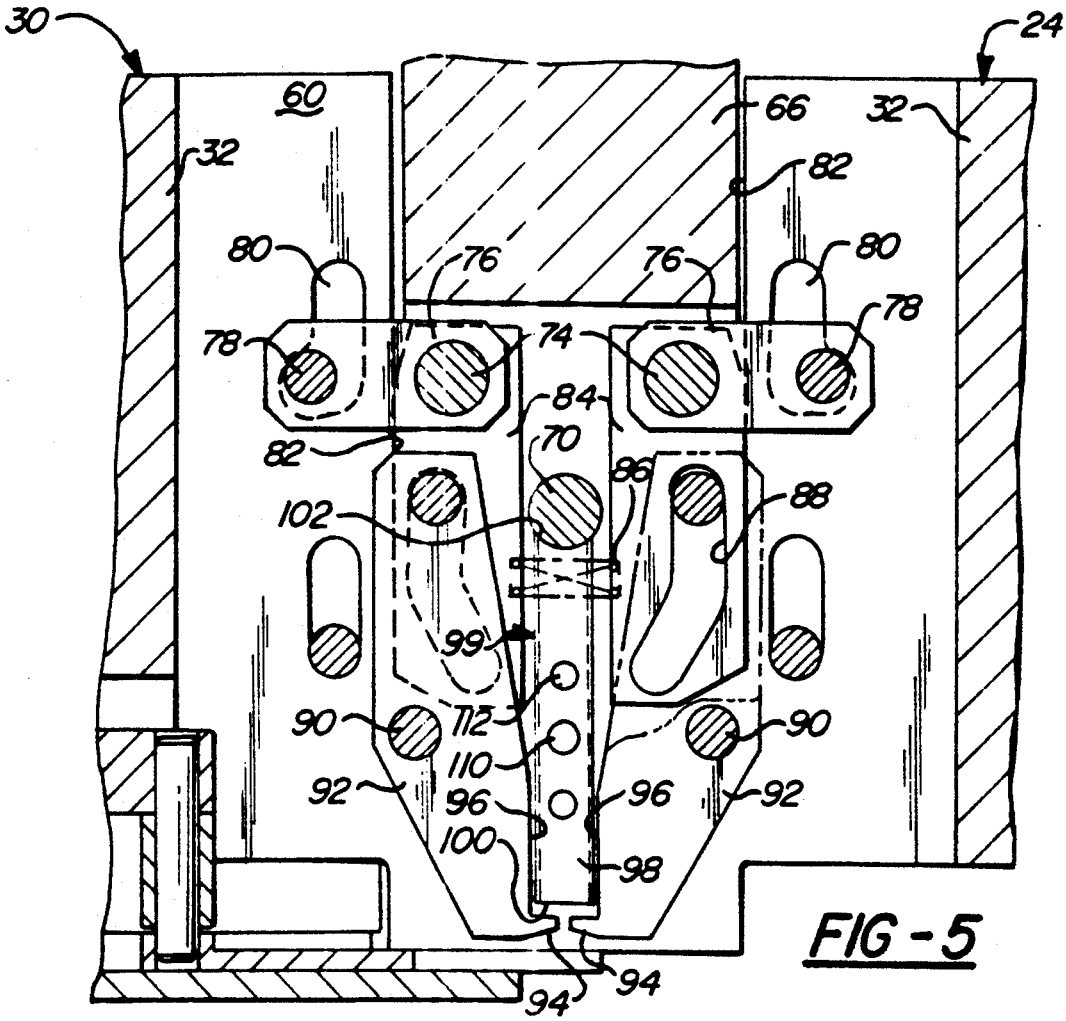
FIG. 5 is a cross-sectional view taken along lines 5—5 of FIG. 4 and showing clamp elements and cutter elements.

Housing and Guides. As shown in FIGS. 4 and 5, the band head 24 has a housing comprising a side wall portion 30 having three walls 32 and a cover 34 which serves as a fourth wall to complete the sides of the housing. A base 36 covers a portion of the housing bottom and has an upwardly inclined surface 38 at its inboard end. A retractable cooperating element 40 spaced below the base 36 has a downwardly inclined surface 42 which, with the surface 38, defines a funnel-like opening for receiving the end of a strap as it is being fed into the track 20, A guide element 44 fastened to the cover 34 has an inclined upper flange 46, and an outer stationary member 48 and an inner stationary member 50 spaced from the flange 46 to form a funnel-like slot for receiving the strap being fed from the feed device 28 to the band head. As will be seen below, the inner member 50 has an inboard end 52 serving as a cutting edge and a lower surface 54 serving as a clamp jaw. A second retractable member 56 spaced below the inner and outer members 48 and 50 has an outward and downward inclined upper surface 58 to define another funnel-like slot which receives the strap end as it exits the track 20 to enter the band head where it overlaps the incoming strap from the feed device.

Drive Mechanism. Within the housing, a guide insert 60 supported on the base 36 and in contact with the wall 32 opposite the cover has a vertical channel 62 and the inside wall of the cover has a corresponding vertical channel 64. A ram 66 operated by the cylinder 26 slides vertically within the housing and has two depending ears 68 which hold a horizontal main drive pin 70, the pin 70 having ends 72 which are slidably retained in the channels 62 and 64. A pair of secondary drive pins 74 above and to either side of the main drive pin are also held by the ears 68 of the ram 66. The pins 74 each pass through a pair of drive links 76 between the ears 68, the links being pivotally journaled at one end on the pins 74. The other end of each link 76 engages a rod 78 which extends across the housing and has one slidably engaged in an L-shaped slot 80 in the guide insert 60 and the other end in a similar slot in the cover 34.

Clamp. A pocket defined by vertical side walls 82 on the inside of the cover 34 contains a pair of spaced sliding blocks 84 which are journaled at their upper ends to the drive pins 74. A compression spring 86 between the blocks urge them toward the side walls 82. Each sliding block 84 contains a cam slot 88 which has an upper vertical section and a contiguous lower section inclined downwardly and toward the other block 84. A pair of rods 90 below the lowest position of each block 84 are rotatably journaled in the insert 60 and the cover 34 and carry clamp arms 92 which are generally vertically elongated and have an inboard finger or clamp jaw 94 movable into opposition with the clamp surface 54 of the stationary member 50 for holding the strap 10 and movable to a release position upon pivoting about the axis of the respective rod 90. The upper end of each clamp arm 92 carries a short pin which rides in the cam slot 88 of a block 84 such that as the ram 66 and the blocks 84 move up the clamp arms 92 move to release position and conversely, when the ram descends the clamps jaws close against the strap 10. Due to the shape of the cam slots 88 the clamping movement occurs during the first half of the ram descent which is caused by actuation of the first tandem cylinder 26. The clamp position is maintained during the second half of the ram descent which is caused by actuation of the second tandem cylinder 26. This allows the clamp to be closed early in the ram cycle so that strap tensioning can occur before crimping.

Cutter Mechanism. A second pair of inner side walls 96 of the cover 34 are closely spaced to define a narrow vertical channel which receives a knife 98 of a cutter assembly 99. The lower end of the knife 98 has a sharp edge 100 which cooperates with the cutting edge on the inboard end 52 of the stationary member 50 to sever the strap 10 from the supply strap 10'. The upper end of the knife has a concave surface 102 which is engaged by the main drive pin 70 during its downward stroke to actuate the knife. The remainder of the cutter assembly 99 comprises a block 104 which resides between the blocks 84 and below the spring 86, and an outboard plate 106 having a slot 108 encompassing an end 72 of the drive pin 70. A bolt 110 and pins 112 secure the assembly. When the ram 66 moves up, the drive pin 70 engages the end of the slot and pulls the cutter assembly up. When the ram descends, the drive pin 70 engages the concave surface 102 of the knife 98 and pushes the assembly 99 down.

Figure 6:
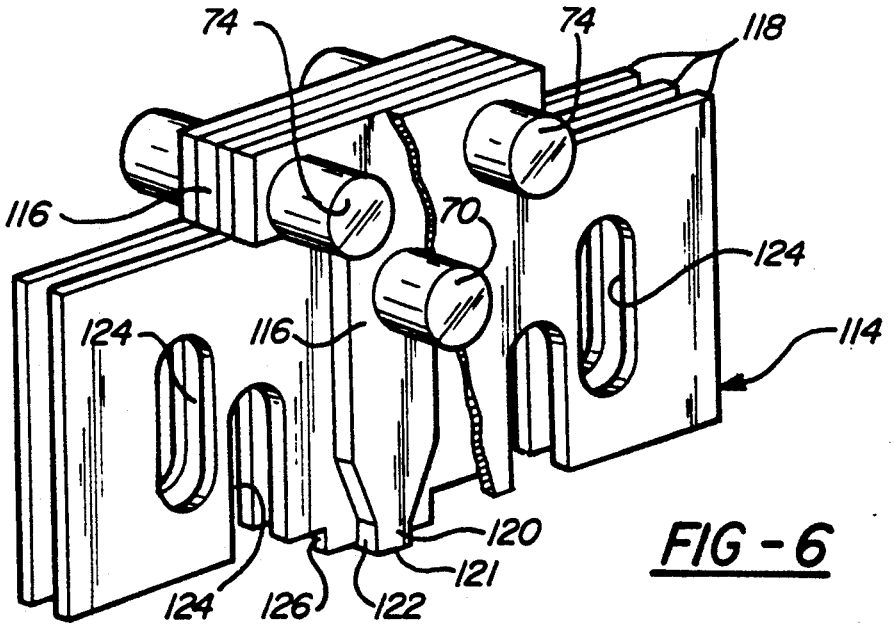
FIG. 6 is an isometric view of an anvil assembly of the band head of FIG. 3.

Crimp Tooling. FIGS. 4 and 6 show a laminate anvil assembly 114 comprising two anvil blades 116 sandwiched between three plates 118, and all secured to the three driving pins 70 and 74 for reciprocating movement with the ram 66. Each anvil blade 116 is T-shaped for attachment to the driving pins at the top and center, and terminates at the bottom in a narrow nose 120 having a flat bottom 121 for contacting the top surface of the strap 10 and vertical sides 122 which help shape the crimp tabs 16 and define their angle normal to the strap surface. The plates 118 have vertically extending slots 124 for accommodating transverse rods in the band head and permitting vertical plate movement relative to the rods. The bottom center of each plate 118 has a cutting edge 126 flush with the bottom of the nose 120 for contact with the strap and somewhat wider than the nose. The cutting edge 126 has sharp corner edges and cut the tabs 16 from the strap when crimp blades 128 aligned with the anvil blades 116 push up on the strap 10 in the regions between the cutting edges. The plates 118 serve to guide and space the crimp blades 128, and thus the spacing of the crimp blades and of the tabs 16 is established by the width of the center plate 118. It is preferred that the three plates 118 be identical. The width of each tab 18 is the same as the anvil blade 116 width.

Figure 7:
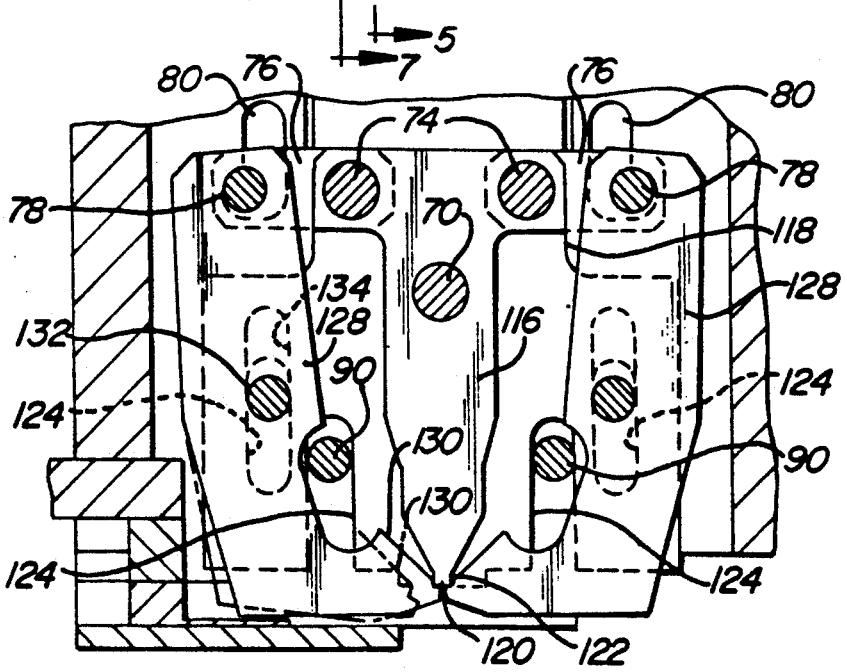
FIG. 7 is a cross-sectional view taken along line 7—7 of FIG. 4 and showing crimping blades in cooperation with the anvil assembly and with the tooling in down position.
Figure 8:
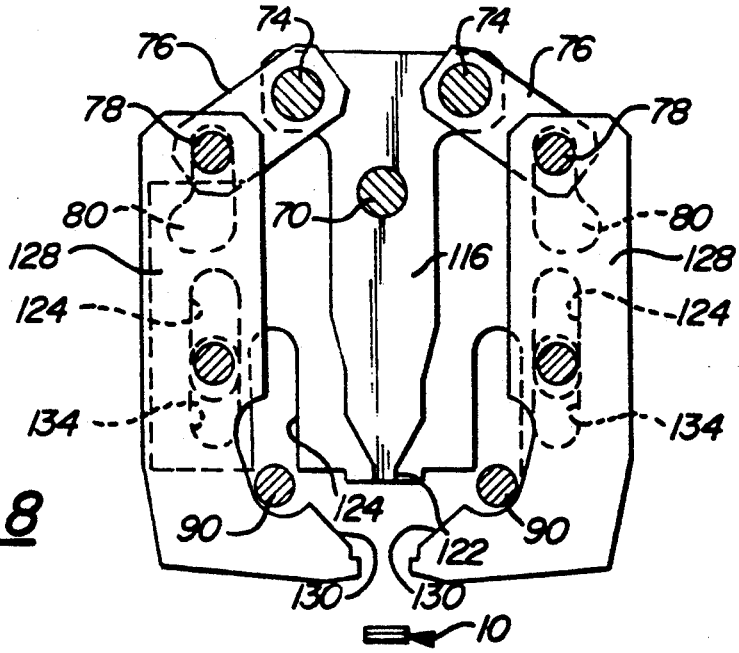
FIG. 8 is a partial view of the FIG. 7 section with the tooling in up position.

FIGS. 7 and 8 show the crimp blades 128 and the anvil assembly 114 in the ram down position and the ram up position, respectively. Each crimp blade 128 is elongated generally vertically and has a claw 130 on its lower end which is turned toward the other crimp blade. The blade is shaped to curve around and avoid interference with the transverse rod 90. The top of each blade 128 is apertured for receiving the rod 78 and the center of each blade is similarly apertured to receive a rod 132 which is supported at its ends in vertical slots 134 in the insert 60 and the cover 34. The rods 78 and 132 and the driving links 76 provide the support and driving force for the blades 128 and the slots 80 and 134 govern the path of the blades in response to ram 66 movement. The crimping blades receive lateral support and guidance from the plates 118 which bound the blades 128 on either side, the blades being slightly thinner than the spacing between the plates 118 to allow sliding movement. When in the upper position of FIG. 8 the pins 78 and 132 are at the upper ends of their respective slots 80 and 134. Then the drive links 76 are oriented at a substantial angle to the horizontal so that a downward ram movement causes the links to push down on the blade 128 and urge the rods 78 against the outboard side of the slots 80. In the lower range of the ram movement, the pins 78 move through the longitudinal portions of the slots 88 and finally the drive links assume a horizontal position as shown in FIG. 7.

In operation, starting with the upper position of FIG. 8, when the ram descends the links 76 push the blades 128 straight down as guided by the vertical portion of the slot 80, and the anvil assembly 114 descends as well, so that the relative positions of the anvil assembly and the crimp blades are unchanged. The claws 130, however move from a position above the strap 10 to a position below the level of the strap as shown in phantom lines in FIG. 7. Then, as the ram descent continues, the anvil assembly reaches the strap as the outward movement of the rods 78 in the horizontal portion of the slot 80 causes the blades to pivot about the rods 132 which reach the bottoms of the slots 134. The claws 130 then move inward and upward, pushing the strap against the anvil assembly 114 and forming the tabs 16. The place in the band head where the crimping tooling meets the strap is the crimping station and is immediately adjacent the stationary member 50 which is used for cut off and clamp functions.

Figure 9:
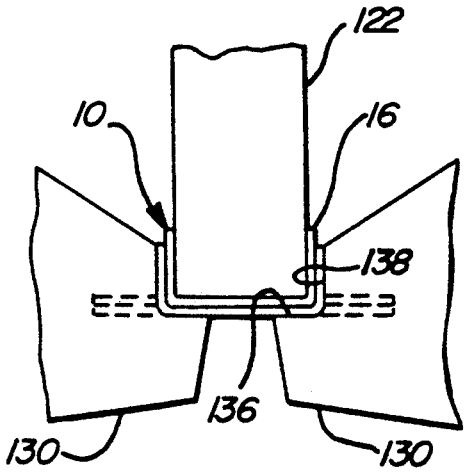
FIG. 9 is a detail view of the crimp forming region of FIG. 7 showing the crimp formation.

As best seen in FIG. 9, the inboard end of each claw 130 has a cutter tip comprising an upper horizontal edge 136 which contacts the bottom of the overlapping straps in the extreme ram down position, and an adjacent vertical edge 138 which, during final descent of the ram, presses up on the straps, causing them to cut on the cutting edge 126 to form a tab 16, and finally presses the tab against the sides 122 of the anvil blade 116.

Operation: In summary of the overall operation which is under the controller 29, strap stock 10, is fed into a crimping station in the band head 24 and is guided by a track 20 surrounding the core 22. When the strap end passes into the crimping station for the second time in overlapping relation with stock which just entered the station, the first cylinder 26 is actuated by the admission of air pressure to push the ram down half way, causing the clamp jaws 94 to clamp the strap end against the clamping surface 54. The ram is held at the half way position while the strap stock 10' is retracted to tightly wrap around the core 22. The tension on the strap is inferred from the current drawn by a servomotor in the feeding apparatus 28 which is monitored by the controller 29. The strap tightening process may require three seconds or more. When the desired tension is achieved, the second cylinder is actuated to complete the ram travel. Then the anvil assembly 114 descends into contact with the strap and the claws 130 move beneath the strap and then upward to form the tabs 16 and push them up between the cutting edges 126 and against the sides 122 of the anvil blades 116. During the final down motion of the ram the knife 98 cuts off the strap 10 from the stock Upon upward movement of the ram the crimp claws 130 and the clamp jaws 54 retract and the retractable elements 40 and 56 are also withdrawn to release the strap. When the strap 10 is released it snaps against the core 22. The sharp tabs 16 on the strap point away from the core so that they do not damage the core when the strap engages the core. The entire cycle time including feeding the strap into the track 20 is accomplished in 8 or 9 seconds.

The embodiments of the invention in which an exclusive property or privilege is claimed are defined as follows:

1. A tool for crimping together the overlapping ends of a strap comprising:

means for holding the strap in a crimping station;

anvil means mounted for movement against a first side of the strap;

blade means mounted for movement against a second side of the strap in cooperation with the anvil means for cutting crimp tabs from the overlapping strap ends and bending the tabs normal to the strap;

the anvil means and the blade means having a rest position on the same side of the strap; and linear actuator means movable between a rest position and a work position and coupled directly to the anvil means for moving the anvil means from its rest position to its work position against the said first side of the strap; and a motion transfer mechanism coupling the linear actuator means to the blade means for moving the blade means from its rest position to its work position at the second side of the strap.

2. The invention as defined in claim 1 wherein the means for holding the strap includes a stationary member on one side of the strap end adjacent to the crimping station, and clamping fingers on the other side of the strap end and movable by the actuator means toward the stationary member to clamp the strap end.

3. The invention as defined in claim 1 wherein the blade means comprises two sets of blades spaced along the length of the strap, each set having a pair of blades on opposite sides of the strap location for cutting and bending tabs from both sides of the strap.

4. The invention as defined in claim 3 wherein the anvil means comprises a laminate structure including three cutter plates and a pair of anvil plates sandwiched between the cutter plates; and each pair of blades being slidably disposed between adjacent cutter plates on opposite sides of an anvil plate for movement in the plane of said anvil plate, each blade having a cutter tip engaging one side of the strap and cooperating with the adjacent cutter plates for cutting a tab from the strap.

5. The invention as defined in claim 1 wherein the motion transfer means comprises links articulated to the actuator means by first pins and to the blade means by second pins, and cam means for guiding the second pins in a path to move the blade means to its work position for cutting tabs from the strap when the actuator moves to the work position.

6. The invention as defined in claim 1 including a cut-off means for cutting the strap end from strap stock comprising;

a stationary cutting edge adjacent the strap;

a knife coupled to the actuator for movement to the cutting edge for severing the strap when the actuator moves to its work position and for retraction from the cutting edge when the actuator moves to its home position.

* * * * *